US009107465B2

(12) United States Patent
Koh

(10) Patent No.: US 9,107,465 B2
(45) Date of Patent: Aug. 18, 2015

(54) ANGLE-ADJUSTABLE SUN CAP

(71) Applicant: PNG CORPORATION, Seoul (KR)

(72) Inventor: Ho Seong Koh, Seoul (KR)

(73) Assignee: PNG CORPORATION, Seoul (KR)

( * ) Notice: Subject to any disclaimer, the term of this patent is extended or adjusted under 35 U.S.C. 154(b) by 0 days.

(21) Appl. No.: 14/100,162

(22) Filed: Dec. 9, 2013

(65) Prior Publication Data

US 2015/0040292 A1 Feb. 12, 2015

(30) Foreign Application Priority Data

Aug. 6, 2013 (KR) ..... 10-2013-0092925

(51) Int. Cl.
*A42B 1/00* (2006.01)
*A42B 1/06* (2006.01)

(52) U.S. Cl.
CPC ..... *A42B 1/064* (2013.01)

(58) Field of Classification Search
CPC ..... A42B 1/006; A42B 1/064; A42B 3/185; A42B 3/223; A42B 2/326; A41D 20/00
USPC ..... 2/10
See application file for complete search history.

(56) References Cited

U.S. PATENT DOCUMENTS 4,726,074 A * 2/1988 Baclit et al. ..... 2/10
5,416,315 A * 5/1995 Filipovich ..... 250/214 VT
5,901,369 A * 5/1999 Pilney ..... 2/6.5
8,341,770 B2 * 1/2013 Siegler et al. ..... 2/411
8,584,265 B2 * 11/2013 Lilenthal et al. ..... 2/417
2003/0088907 A1 * 5/2003 Gafforio et al. ..... 2/424
2005/0273912 A1 * 12/2005 Gafforio et al. ..... 2/424
2007/0067887 A1 * 3/2007 Lee ..... 2/12
2007/0074335 A1 * 4/2007 Gafforio et al. ..... 2/410
2007/0245467 A1 * 10/2007 Lilenthal et al. ..... 2/416
2011/0060260 A1 * 3/2011 Siegler et al. ..... 602/18
2012/0066818 A1 * 3/2012 Pierini et al. ..... 2/411
2014/0352020 A1 * 12/2014 Isobe ..... 2/9

FOREIGN PATENT DOCUMENTS

KR 20-0239194 Y1 10/2001
KR 10-2002-0024012 A 3/2002
KR 20-0426424 Y1 9/2006
KR 10-0775904 B1 11/2007
KR 10-1181720 B1 9/2012

* cited by examiner

*Primary Examiner* — Amy Vanatta
*Assistant Examiner* — Sally Haden
(74) *Attorney, Agent, or Firm* — LRK Patent Law Firm

(57) ABSTRACT

An angle-adjustable sun cap includes a band unit, a visor unit attached to the band unit to be rotatable on the band unit, and a cap side coupling device that couples the band unit and the visor unit, in which the cap side coupling device includes an inner coupler and an outer coupler. With the cap side coupling device, the angle between the band unit and the visor unit may be adjusted and the band unit and the visor unit may be correctly fixed at the adjusted angle.

6 Claims, 4 Drawing Sheets

ANGLE-ADJUSTABLE SUN CAP

BACKGROUND OF THE INVENTION

1. Field of the Invention

The present invention relates to a sun cap, and more particularly, to a cap side coupling device that couples a band unit and a visor unit of a sun cap and adjusts an angle between the band unit and the visor unit.

2. Description of the Prior Art

Conventional sun caps may be classified into a fixed type sun cap in which a band unit and a visor unit are fixed to each other and an angle-adjustable type sun cap in which the angle of a visor unit coupled to a band unit is adjustable. An example of the fixed type sun cap is disclosed in Korean Patent No 10-1181720 registered in the name of the present applicant and entitled "Sun Cap with Gradation Visor". The patent discloses a sun cap that comprises: a visor which is coated with a color such that the color is gradated to fade as approaching outside from a wearer's forehead; a head support integrally formed with the visor to be fixed to the forehead; a pair of fixing legs hinged to the opposite ends of the head support to be folded; and hinge means configured to couple the head support and the fixing legs. Since the material of the visor is identical to that of glasses, the strength of the visor may be improved. In addition, since the visor is coated with a color such that the color is gradated to fade as approaching outside from the wearer's forehead, the visor may efficiently shield ultraviolet rays while securing a clear view. However, in the granted invention, since the band unit and the visor are fixed to each other, it is impossible to adjust the angle of the visor even when the sunlight is strong. As a result, there is a problem in that the wearer's eyes may not be protected.

In addition, an example of the angle-adjustable type sun cap is disclosed in Korean Utility Model Registration No. 20-0426424 entitled, "Sun Cap". The Utility Model discloses a sun cap in which, when a visor of the sun cap covers a user's eyes, a transparent visor portion of a polycarbonate film is disposed at a portion corresponding to the user's field of vision and at least one opaque visor portion which is thinner than the transparent visor portion is disposed at the remaining portion. The transparent visor portion and the opaque visor portion are connected with each other through backstitching so as to form the visor. The invention is configured such that the angle of the transparent visor portion may be adjusted about a hinge axis. However, since the transparent visor portion cannot be fixed, there is a problem in that the transparent visor portion may slip down as time goes on.

SUMMARY OF THE INVENTION

Accordingly, the present invention has been made to solve the above-mentioned problems occurring in the prior art, and an aspect of the present invention is to provide an angle-adjustable sub cap including a side coupling device configured to adjust and fix an angle between a band unit and a visor unit in such a manner that the angle of the visor unit coupled to a band unit may be adjusted and the band unit and the visor unit may be correctly fixed at the adjusted angle. The side coupling device includes an outer coupler and an inner coupler.

In order to accomplish this object, there is provided an angle-adjustable sun cap including: a band unit; a visor unit attached to the band unit to be rotatable on the band unit; and a side coupling device that couples the band unit and the visor unit. The side coupling device includes an inner coupler provided with one or more insertion grooves and an outer connector provided with one or more fixing protrusions. The outer coupler is integrally formed with the visor unit and the inner coupler is integrally formed with the band unit, and the outer connector is assembled with the inner connector in such a manner that the outer connector may be rotated or fixed on the inner connector so as to rotate the visor unit on the band unit or to fix the visor unit on the band unit.

The inner coupler may include one or more latch fixing portions each of which is provided with a fixing groove. In addition, the inner coupler may include a fixing latch of which the opposite ends are fixed to the fixing grooves, respectively.

The fixing latch of the inner coupler may be configured by an M-shaped leaf spring.

The fixing protrusions of the outer coupler are rotatably inserted into the insertion grooves, respectively, so as to allow the outer coupler to be rotated on the inner coupler so that the visor unit may be rotated on the band unit.

The outer coupler may be formed in a circular shape and includes a toothed fixing portion formed on an inner circumference of the outer coupler. When the visor unit is rotated, the toothed fixing portion is rotated on the fixing latch and when the visor unit is stopped, the fixing latch is fixedly engaged with teeth of the toothed fixing portion.

The sun cap may further include a first protrusion and a second protrusion which are formed inside a side coupling device cover and fitted to a first hole and a second hole formed inside the outer coupler of the visor unit.

An inner member formed by a sponge covered with a cloth may be attached to an inner surface of the band unit.

The visor unit may be formed to be transparent or have a color selected from various colors.

The band unit may be formed with a V-groove so as to allow the inner member to be quickly, conveniently and correctly attached as well as so as to provide a sense of beauty.

As described above, the angle-adjustable sun cap according to the present invention includes a band unit, a visor unit attached to the band unit to be rotatable on the band unit; and a side coupling device that couples the band unit and the visor unit, in which the side coupling device includes an inner coupler and an outer coupler. With the side coupling device, the angle between the band unit and the visor unit may be adjusted and the band unit and the visor unit may be correctly fixed at the adjusted angle.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
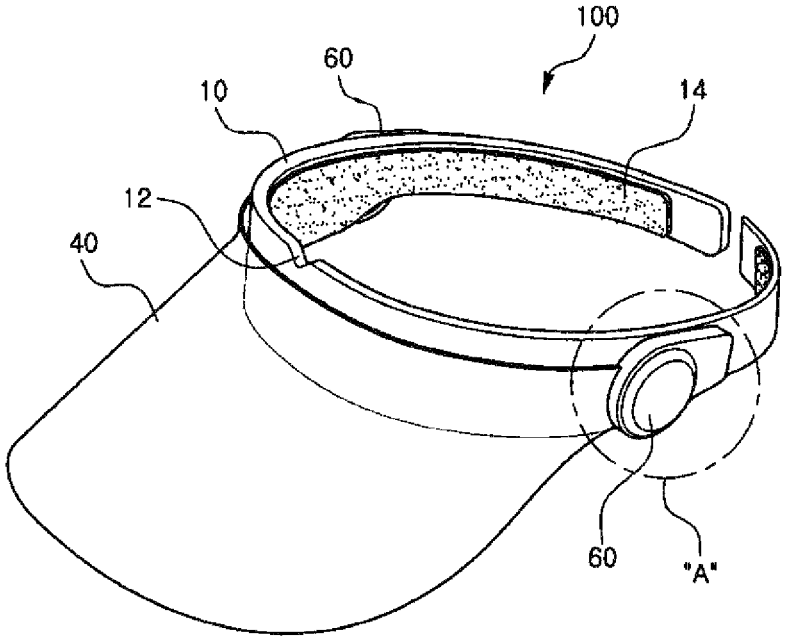
FIG. 1 is a perspective view illustrating a sun cap according to an exemplary embodiment of the present invention.

The present invention provides an angle-adjustable sun cap including: a band unit 10; a visor unit 40 attached to the band unit 10 to be rotatable on the band unit; and a side coupling device 60 that couples the band unit 10 and the visor unit 40. The side coupling device 60 includes an inner coupler 20 provided with one or more insertion grooves 24 and 24' and an outer coupler 50 provided with one or more fixing protrusions 54 and 54'. The outer coupler 50 is integrally formed with the visor unit 40 and the inner coupler 20 is integrally formed with the band unit 10. The outer coupler 50 is assembled with the inner coupler 20 in such a manner that the outer coupler 50 may be rotated or fixed on the inner coupler 20 so as to rotate the visor unit on the band unit or to fix the visor unit on the band unit.

Hereinafter, exemplary embodiments of the angle-adjustable sun cap according to the present invention will be described in detail with reference to accompanying drawings.

FIG. 1 is a perspective view illustrating a sun cap according to an exemplary embodiment of the present invention. As illustrated in FIG. 1, the sun cap 100 according to the present exemplary embodiment includes a band unit 10 held on a wearer's head, a visor unit 40 that shields sun light (ultraviolet rays), and a side coupling device 60 that couples the band unit 10 and the visor unit 40.

In FIG. 1, the side coupling device 60 is illustrated in a dot-and-dash line circle A.

An inner member 14 formed by a sponge covered with a cloth may be further attached to the inner surface of the band unit 10. The visor unit 40 may be formed to be transparent or have a color selected from various colors.

The band unit 10 may be further formed with a V-groove so as to allow the inner member 14 to be quickly, conveniently and correctly attached as well as so as to provide a sense of beauty.

Figure 2:
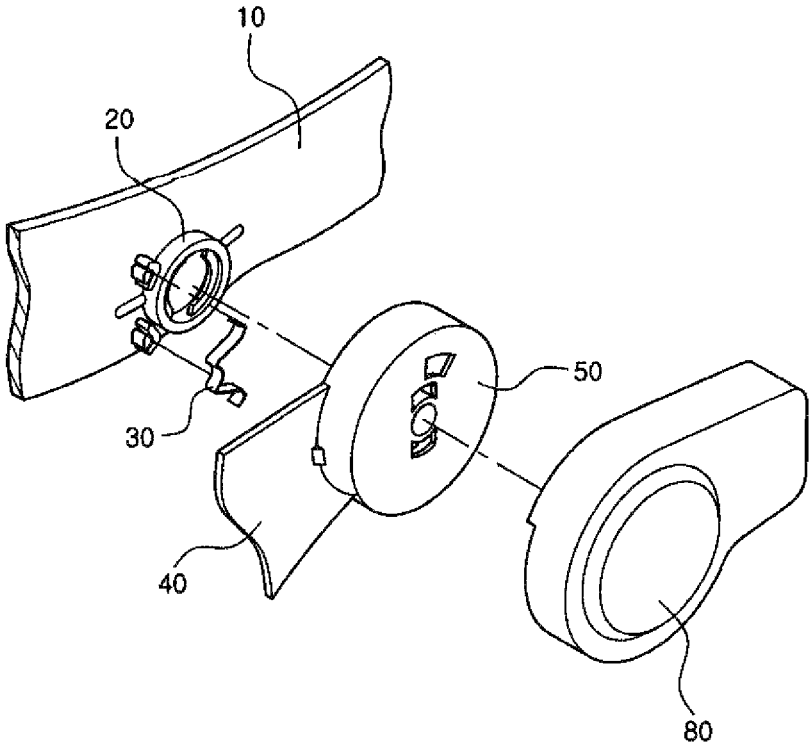
FIG. 2 is an exploded perspective view illustrating a side coupling device of the sun cap illustrated in FIG. 1.

FIG. 2 is an exploded perspective view illustrating a side coupling device of the sun cap illustrated in FIG. 1. The features of the present exemplary embodiment include the band unit 10, the visor unit 40 and the side coupling device 60.

As illustrated in FIG. 2, the side coupling device 60 includes an inner coupler 20 and an outer coupler 50 in which the inner coupler 20 includes a latch fixing portion 30.

The outer coupler 50 is integrally formed with the visor unit 40 and the inner coupler 20 is integrally formed with the band unit 10. One of the most important features of the present invention is that the outer coupler 50 is integrally formed with the visor unit 40 and the inner coupler 20 is integrally formed with the band unit 10.

When outer coupler 50 is integrally formed with the visor unit 40 and the inner coupler 20 is integrally formed with the band unit 10, no separate additional coupling device is required so as to couple the visor unit and the band unit.

As the coupler is formed by a portion of the visor unit or a portion of the band unit as described above, the manufacturing process may be simplified and quickly and economically performed and a final product may be slimmed.

However, it is important to use a high-strength material in order to integrally produce principal elements in a product as described above.

As for the sun cap according to the present invention, polycarbonate may be preferably used as a material.

Polycarbonate has an impact resistance which is 150 or more times of that of a tempered glass and is excellent in heat-resistance, flexibility and machinability as well as the impact resistance.

Figure 3:
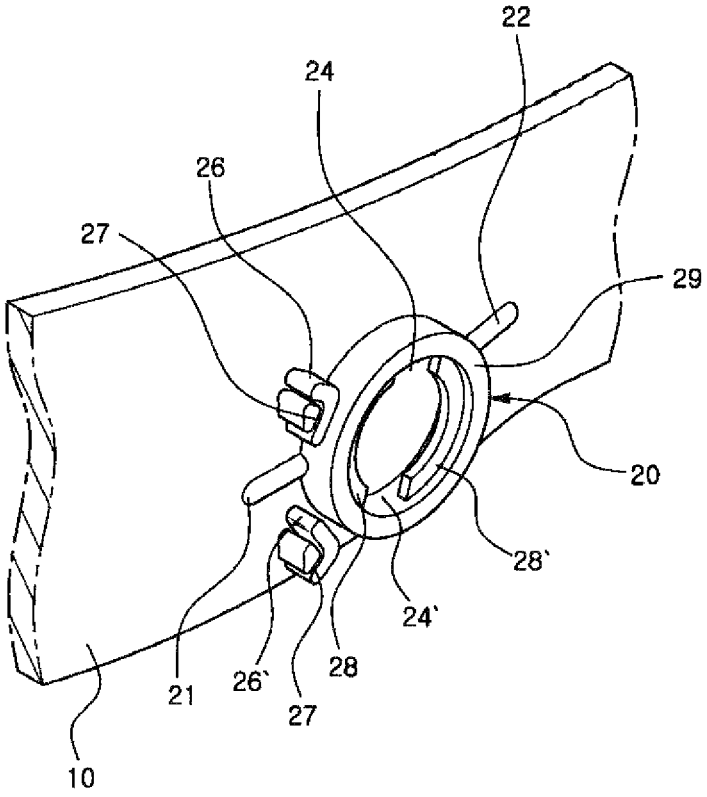
FIG. 3 is a perspective view illustrating an inner coupler of the side coupling device illustrated in FIG. 2.

FIG. 3 is a perspective view illustrating the inner coupler of the side coupling device illustrated in FIG. 2.

The inner coupler 20 is integrally formed with the band unit 10.

The inner coupler 20 has a circular portion 29 which is formed with insertion grooves 24 and 24' and inner walls 28 and 28' therein, latch fixing portions 26, 26 provided in the outside of the circular portion 29 formed with fixing grooves 27 and 27' in the outside of the circular portion 29, an abutment 21, and a stopper.

The abutment 21 serves to hold a latch fixing portion 30 at the bottom side thereof so as to assure that the latch fixing portion 30 and a toothed fixing portion 52 may be securely engaged with each other. The stopper 22 is provided so as to allow the outer coupler to be rotated to a predetermined limit (until the outer coupler comes into contact with a second protrusion of a side coupling device cover (see FIG. 7)) when the outer coupler is rotated on the inner coupler (see FIGS. 3 and 6).

Figure 4:
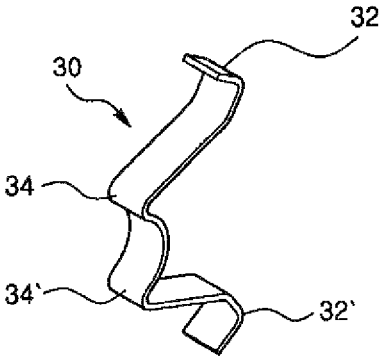
FIG. 4 is a perspective view illustrating a fixing latch of the side coupling device illustrated in FIG. 2.

FIG. 4 is a perspective view illustrating a fixing latch according to an exemplary embodiment of the present invention.

The inner coupler 20 includes a fixing latch 30 which may be formed of a metal in an "M" shape. For example, a leaf spring may be used as the fixing latch 30. The opposite ends 32 and 32° of the fixing latch are fixed to the fixing grooves 27 and 27' of the latch fixing portions 26 and 26'.

Figure 5:
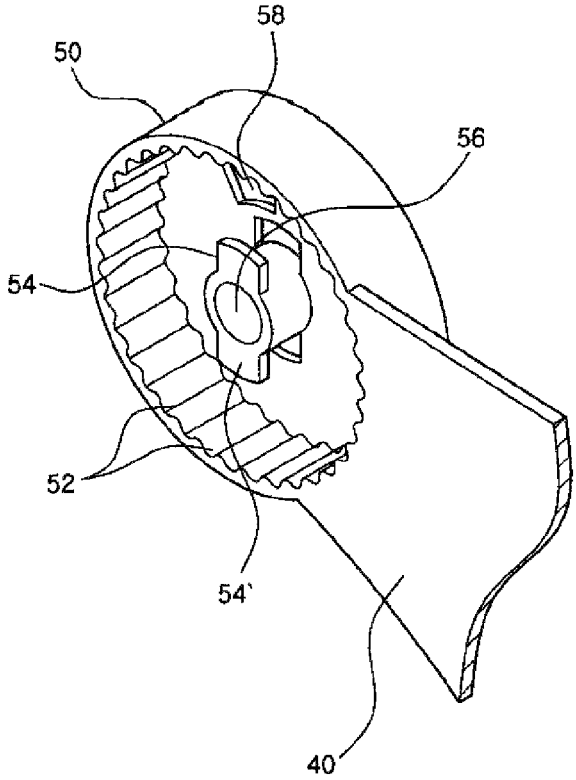
FIG. 5 is a perspective view illustrating an outer coupler of the side coupling device illustrated in FIG. 2.

FIG. 5 is a perspective view illustrating an outer coupler according to an exemplary embodiment of the present invention.

The outer coupler 50 is integrally formed with the visor unit 40.

The outer coupler 50 is formed in a circular shape and a toothed fixing portion 52, fixing protrusions 54 and 54', a first hole 56 and a second hole 58 are formed inside the outer coupler 50.

The outer coupler 50 is assembled with the inner coupler 20 and the outer coupler is configured to be rotated or fixed on the inner coupler. Thus, the visor unit may be rotated or fixed on the band unit.

The fixing protrusions 54 and 54' of the outer coupler 50 are rotatably inserted into the insertion grooves 24 and 24' of the inner coupler 20 so that the outer coupler may be rotated on the inner coupler. Thus, the visor unit may be rotated on the band unit.

The outer coupler 50 is formed in a circular shape and the toothed fixing portion 52 is formed on the inner circumference of the outer coupler 50. When the visor unit 40 is rotated, the toothed fixing portion 52 is rotated on the fixing latch 30 and when the visor unit 40 is stopped, the top portions 34 and 34' of the fixing latch 30 are fixedly engaged with the teeth of the toothed fixing portion 52.

As described above, the fixing latch 30 is formed of a metal in an M shape and a leaf spring may be used as for the fixing latch 30. Using the elastic force of the leaf spring which is contracted when the visor unit 40 is rotated and expanded when the visor unit 40 is stopped, the visor unit 40 may be rotated or stopped on the band unit 10.

Figure 6:
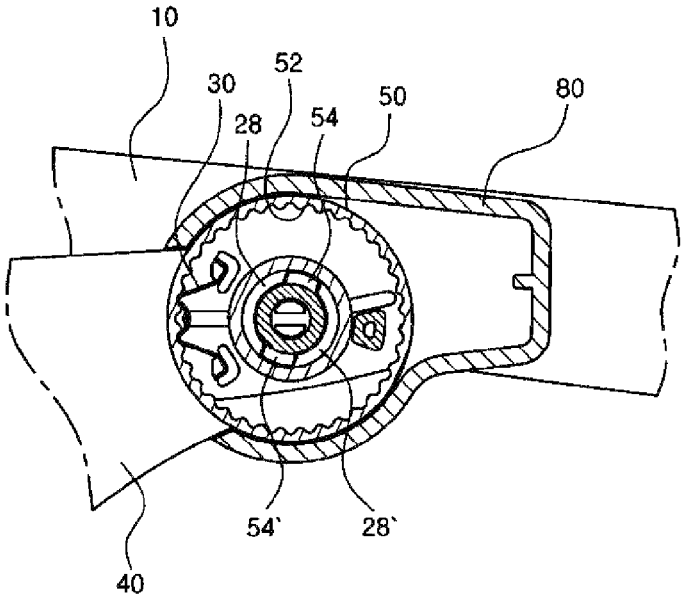
FIG. 6 is a cross-sectional view illustrating the side coupling device of FIG. 2 in the assembled state.

FIG. 6 is a cross-sectional view illustrating the side coupling device in the assembled state.

As illustrated in FIG. 6, the fixing latch 30 is engaged with the toothed fixing portion 52 when the outer coupler 50 is assembled to the inner coupler 20, and a side coupling device cover 80 is provided on the outside of the outer coupler 50.

Figure 7:
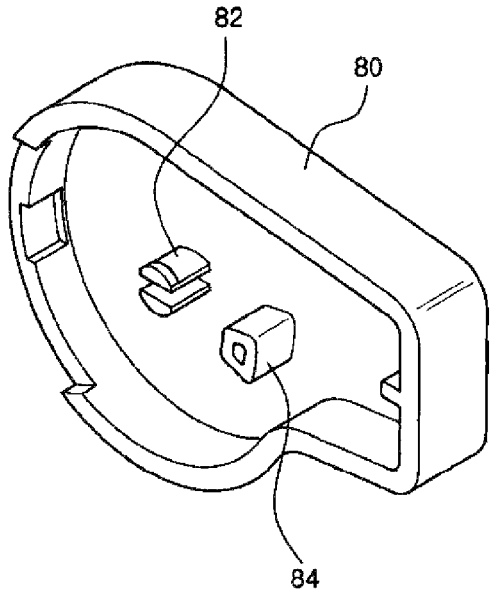
FIG. 7 is a perspective view illustrating a side coupling device cover according to an exemplary embodiment of the present invention.

FIG. 7 is a perspective view illustrating the side coupling device cover according to the exemplary embodiment of the present invention. The side coupling device cover 80 is formed with a first protrusion 82 and a second protrusion 84.

The first protrusion 82 and the second protrusion 84 are engaged with a first hole 56 and a second hole 58 formed inside the outer coupler 50 of the visor unit 40.

Figure 8:
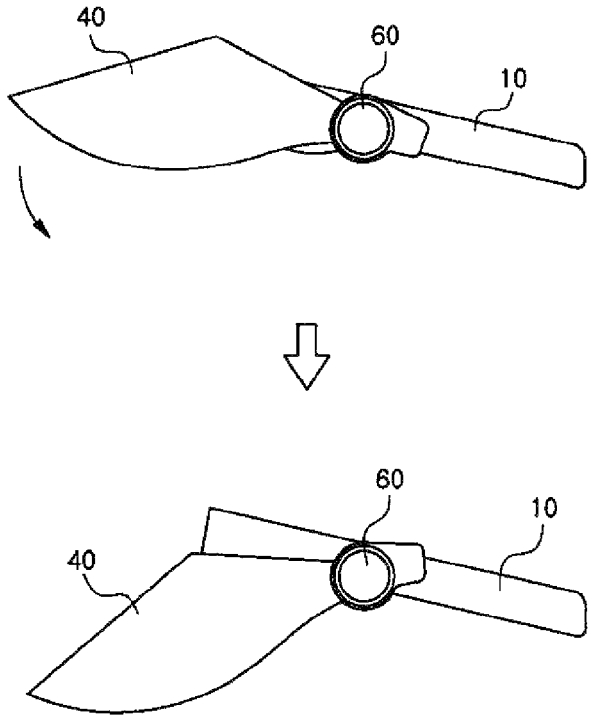
FIG. 8 is a schematic view illustrating the operation of the sun cap according to the exemplary embodiment of the present invention.

FIG. 8 is a schematic view illustrating the operation of the sun cap according to an exemplary embodiment of the present invention.

When a downward force is applied to the visor unit 40 which is horizontally positioned in relation to the band unit 10, the outer coupler 50 is rotated on the inner coupler 20 as illustrated in the upper drawing in FIG. 8) and thus, the visor unit 40 is rotated as illustrated in the lower drawing in FIG. 8.

Although the present invention has been described with reference to several exemplary embodiments and the accompanying drawings, the terms or words used in the detailed description and claims shall be interpreted to correspond to the technical idea of the present invention in meaning and concept rather than being limitatively interpreted as typical or dictionary meaning. Accordingly, it shall be noted that since the exemplary embodiments described in the detailed description and the configurations illustrated in the drawings merely exemplify the present invention, various equivalents and modified examples may be made without departing from the scope of the present invention which is defined by the accompanying claims and all the equivalents and the modified examples belong to the scope of the present invention.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An angle-adjustable sun cap comprising:

a band unit;

a visor unit attached to the band unit to be rotatable on the band unit; and a side coupling device that couples the band unit and the visor unit, wherein the side coupling device includes an inner coupler provided with one or more insertion grooves and an outer coupler provided with one or more fixing protrusions, the one or more fixing protrusions being inserted into the one or more insertion grooves, wherein the outer coupler is integrally formed with the visor unit and the inner coupler is integrally formed with the band unit, wherein the outer coupler is assembled with the inner coupler in such a manner that the outer coupler may be rotated or fixed on the inner coupler so as to rotate the visor unit on the band unit or fix the visor unit on the band unit, wherein the inner coupler comprises a latch fixing portion having a fixing groove therein, and an M-shaped leaf spring fixed to the latch fixing portion, and wherein the outer coupler has an annular shape, and a toothed fixing portion is provided on an inner circumferential surface of the annular outer coupler so that when the visor unit is rotated, the toothed fixing portion is rotated on the M-shaped leaf spring, and when the visor unit is stopped, the M-shaped leaf spring is locked between teeth of the toothed fixing portion.

2. The angle-adjustable sun cap of claim 1, further comprising a first protrusion and a second protrusion which are formed inside a side coupling device cover and fitted to a first hole and a second hole formed inside the outer coupler of the visor unit.

3. The angle-adjustable sun cap of claim 1, wherein the visor unit, the outer coupler, the band unit, and the inner coupler are made of polycarbonate.

4. The angle-adjustable sun cap of claim 1, an inner member formed by a sponge covered with a cloth is attached to an inner surface of the band unit.

5. The angle-adjustable sun cap of claim 4, wherein the band unit is formed with a V-groove so as to allow the inner member to be quickly, conveniently and correctly attached as well as so as to provide a sense of beauty.

6. The angle-adjustable sun cap of claim 1, wherein the visor unit is formed to be transparent or have a color selected from various colors.

* * * * *